United States Patent [19]

Gleason et al.

[11] 4,279,106

[45] Jul. 21, 1981

[54] ROOFING PANEL

[76] Inventors: Charles H. Gleason, 245 W. Lorraine, Glendale, Calif. 91206; James O. Greenleaf, 6669 Juliet La., Canoga Park, Calif. 91307

[21] Appl. No.: 91,570

[22] Filed: Nov. 5, 1979

[51] Int. Cl.[3] ..... E04D 1/08; E04D 1/34

[52] U.S. Cl. ..... 52/100; 52/99; 52/309.8; 52/521; 52/536; 52/558

[58] Field of Search ..... 52/309.4, 309.8, 558, 52/536, 556, 521, 98, 99, 100

[56] References Cited

U.S. PATENT DOCUMENTS

| | | | |
|---|---|---|---|
| 2,438,099 | 3/1948 | Whitehouse | 52/538 X |
| 2,811,118 | 10/1957 | Ball | 52/536 X |
| 3,605,369 | 9/1971 | Merrill et al. | 52/309.8 X |
| 3,783,570 | 1/1974 | Storch | 52/536 X |
| 3,852,934 | 12/1974 | Kirkhuff | 52/556 X |
| 3,868,804 | 3/1975 | Tantlinger | 52/98 |

FOREIGN PATENT DOCUMENTS

| | | | |
|---|---|---|---|
| 1376681 | 9/1964 | France | 52/536 |
| 583540 | 12/1946 | United Kingdom | 52/538 |
| 1282144 | 7/1972 | United Kingdom | 52/536 |

*Primary Examiner*—Alfred C. Perham
*Attorney, Agent, or Firm*—George J. Netter

[57] ABSTRACT

A thin shell of hard plastic has a cavity within which a polyurethane foam is received. Each panel includes an upper, relatively straight-line edge, two side edges at substantially 90 degrees to the upper edge, and a lower, irregular edge having the appearance of a plurality of individual roofing shakes. The upper edge is canted upwardly for receipt within a groove in the underside of an upper overlapping panel. In addition, immediately adjacent the canted upper edge, there is a bandlike section through which roofing nails may be applied for securing the panel to the roof. The undersurface of each panel includes a stepped arrangement, not unlike that encountered in a roof constructed of individual shakes, which arrangement enables a pair of such panels to be fitted together with the top surface of one panel contacting the lower surface of another panel and forming a substantially parallel surface package for storage and shipment. An edge of each panel shell has a plurality of ribs which are pressed into the foam of the underside of an immediately adjacent panel to the side providing a barrier against the access of water.

3 Claims, 9 Drawing Figures

ROOFING PANEL

This invention relates to a roofing construction in which prefabricated panels constructed of a fire-resistant plastic are joined together into an integral structure.

DESCRIPTION OF THE PRIOR ART

Many types of preformed roofing panels or roofing tiles have been available for some time, and which are interconnected and applied to the roof of a dwelling in a number of different ways. The most recent panels have been molded of a synthetic plastic material in the form and appearance of conventional shakes, such as cedar shakes, for example. Of the prior known molded plastic roofing panels, they are all not completely satisfactory for one or more various reasons. Some of the panels are constructed in an exceptionally regular repeated pattern which makes them aesthetically unacceptable to many people. Certain other known panels are relatively difficult to apply to the roof and secure to one another. Still others are not sufficiently durable to withstand the forces resulting from occasional walking on during construction or installation resulting in breakage, while others have a tendency to weather badly and therefore have a relatively short life.

SUMMARY OF THE INVENTION

The roofing panels of this invention include an outer relatively thin shell of a hard plastic having a cavity within which a polyurethane foam is received. Each panel includes an upper, relatively straight-line edge, two side edges at substantially 90 degrees to the upper edge, and a lower, irregular edge having the appearance of a plurality of individual roofing shakes. The upper edge is canted upwardly with respect to the major flat plane of the panel for being received within an appropriately dimensioned groove in the underside of an upper overlapping panel, thereby lockingly engaging the panels together to form the roof. In addition, immediately adjacent the canted upper edge, the plastic shell has a smooth bandlike section through which roofing nails may be applied for securing the panel to the roof, the nailheads being hidden underneath the upper overlapping panel. The undersurface of each panel includes a stepped arrangement, not unlike that encountered in a roof constructed of individual shakes, which arrangement enables a pair of such panels to be fitted together with the top surface of one panel contacting the lower surface of another panel and forming a substantially parallel surface package for storage and shipment. Still further, an edge of each panel shell includes a plurality of elongated ribs which are pressed into the foam of the underside of an immediately adjacent panel to the side providing connection therebetween that is a barrier against the access of water.

DESCRIPTION OF A PREFERRED EMBODIMENT

Figure 1:
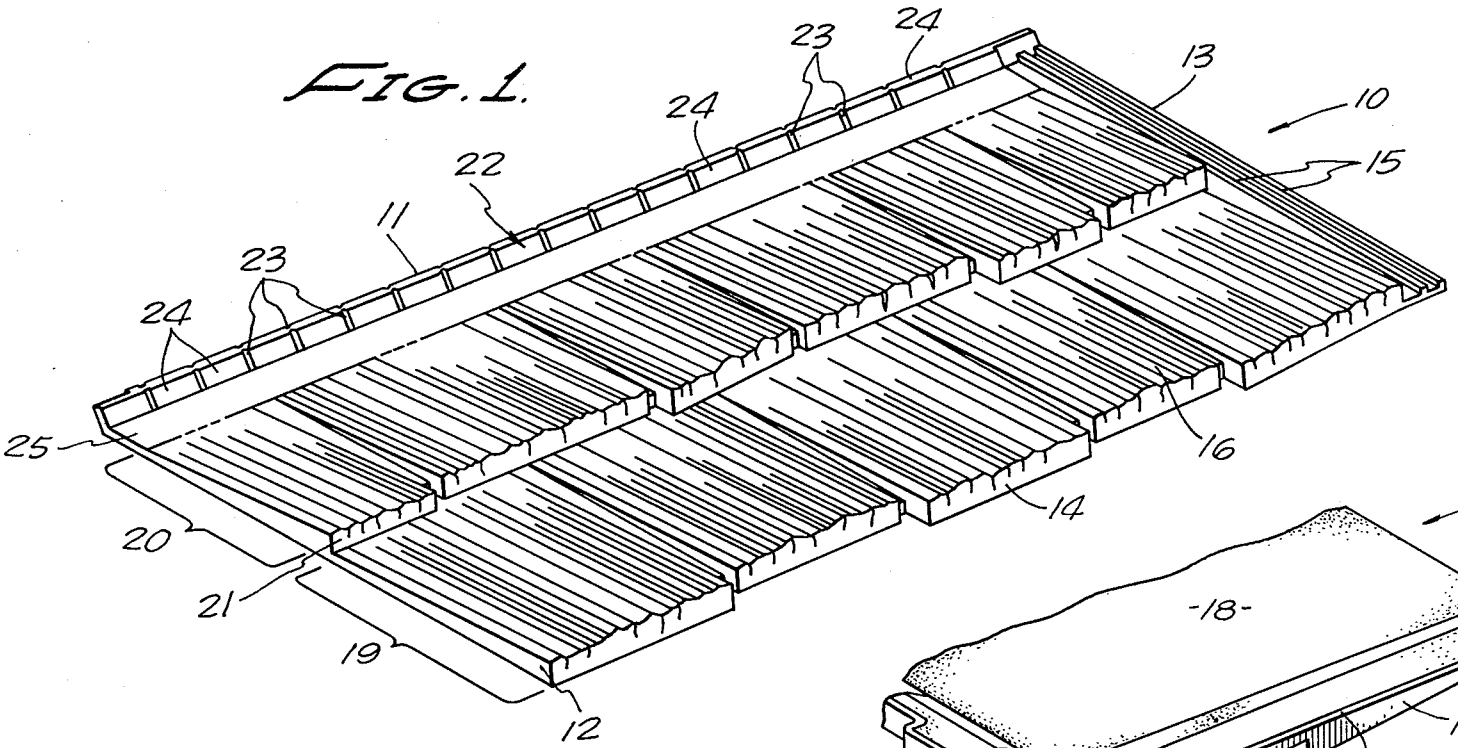
FIG. 1 is a perspective view of a panel constructed in accordance with this invention.

With reference now to the drawing, and particularly FIG. 1, the roofing panel of the subject invention is enumerated generally as at 10, and is seen to comprise a substantially rectangular construction having the appearance of a plurality of shakes or wood shingles arranged in two courses and having an upper edge 11, two side edges 12 and 13, and a lower edge 14. As will be more particularly described, the margin of edge 13 has a plurality of spaced ribs 15 which cooperate with parts of an adjacent panel to secure and lock the two panels together. The upper edge 11, also as will be more particularly described, fits into a groove within the lower surface of a panel located immediately above it to lock the panels together in that direction, both physically and in a manner preventing water from making its way through the panels into the subjacent roofing support.

In appearance, when a plurality of roofing panels 10 are arranged on a roof, they are substantially identical to a typical shake roof or wood shingle roof, in that the individual shake appearing components 16 have their lowermost edges, although substantially aligned, still somewhat irregular as if constructed by applying one shake at a time to the roof surface. This is important from an aesthetic standpoint in that it destroys the objectionable overly uniform geometric appearance of certain known roofing panels.

Figure 2:
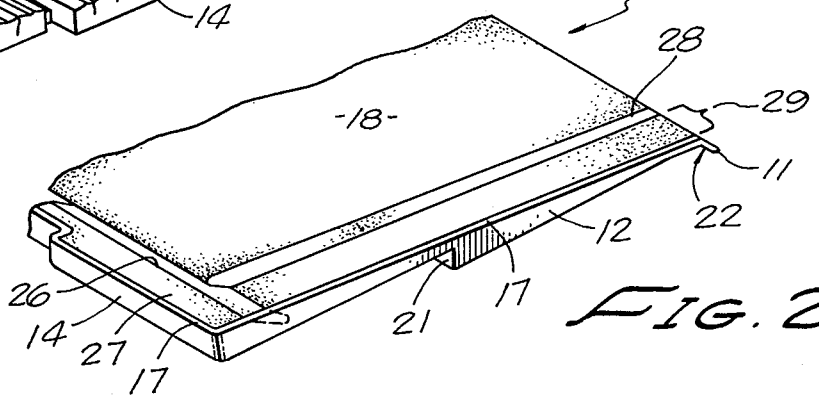
FIG. 2 is a perspective, partially fragmentary view of the panel of FIG. 1, from the underside.

Turning now, additionally, to FIG. 2, the roofing panel 10 is seen to be constructed in its major elements of a relatively thin, hard shell 17, which includes on the underside, an open cavity within which is received a relatively rigid cellular foam 18. Although a number of different materials may be satisfactory from which to make the shell 17, polyester plastics have been found best with the overall shell thickness being arrived at as a balance between providing the necessary strength to weather erosion in use, handling and packaging, and the ability to permit cutting with hand tools. Also, of course, it is required that the panel shells be as lightweight as possible and yet sufficiently flexible to conform to any minor surface irregularities of the roof deck upon which it is to be mounted. All vertical parts of the panel shell are approximately 0.060–0.075 inches (0.152–0.191 cm.) in thickness, with the horizontally arranged shell areas being approximately 0.030–0.035 inches (0.076–0.089 cm.). The flat edge margins which overlap and interlock with similar parts have a thickness maintained at about 0.075 inches (0.191 cm.).

The foam 18 must be hard enough to provide sufficient rigidity for the completed panel, and yet also be capable of being compressed somewhat. A polyurethane foam of about 2 pounds per cubic foot density has been found excellent for this purpose. In addition, the material used for making both the shell and the foam core should provide a high degree of fireproofing for the finished panels which is clearly advantageous for use in a building construction. It will be of assistance in understanding the ensuing description of the detailed panel construction to keep in mind that the overall appearance on a finally installed roof using the panels of this invention, is to be that of the conventional shake roof. That is, when in final condition, such a roof will have the appearance of a plurality of shallow step-like constructions, where a row of shakes run substantially parallel to the roof edge followed by a second overlapping row, and so forth, terminating at the top in an edge arrangement along the roof crown.

Accordingly, although not intended to be restrictive in this regard, a typical panel 10 gives the outward appearance of two rows of individual shakes in overlapping relation to each other. That is, one row or course 19 has an immediately adjacent second row 20 in overlapping relationship forming a step as at 21.

The edge margin 22 adjacent the edge 11 extends angularly upwardly away from the top surface of the row 19, the preferred angle being about 45 degrees. In addition, the margin 22 extends as a band throughout the full width of the panel and includes a plurality of equally spaced thin-wall lines 23 separating the marginal band into a number of generally rectangular tabs 24. The thin-wall sections 23 have a thickness of about 0.030 inches (0.076 cm.) serving break-lines so that tabs (of a width T) can be removed by merely breaking the shell along section 23.

A further headlap band 25 lies next to the edge margin 22 and extends from the ribs 15 to the opposite side edge. This band has a smooth upwardly directed surface and a thickness of approximately 0.060 inches (0.152 cm.) which has been found to be sufficiently thin to accept nails therethrough and yet strong enough for maintaining the panel secured to the roof.

Figure 3:
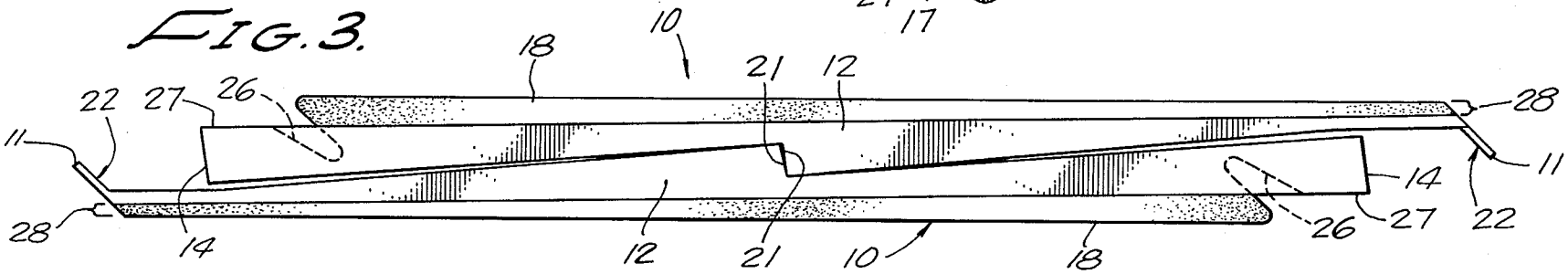
FIG. 3 is a side elevational view of a pair of roofing panels nested for storage or shipment.
Figure 4:
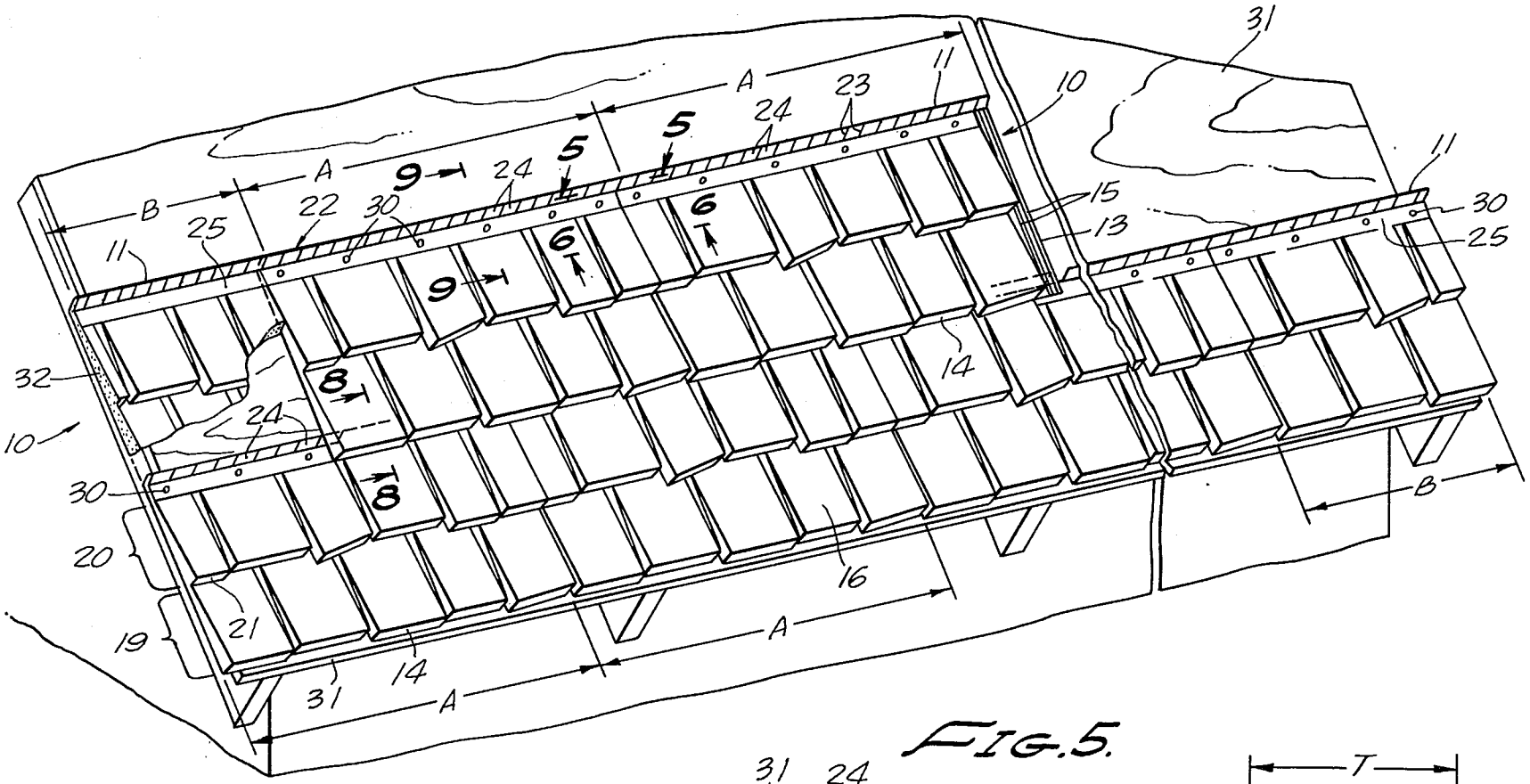
FIG. 4 shows a plurality of panels of this invention installed on a roof.
Figure 5:
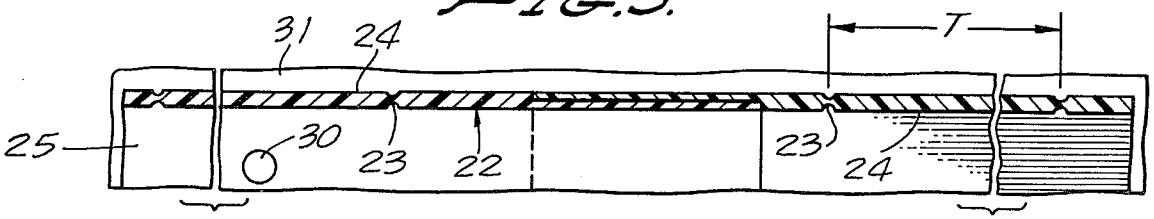
FIG. 5 is a sectional, elevational view taken along the line 5—5 of FIG. 4.
Figure 8:
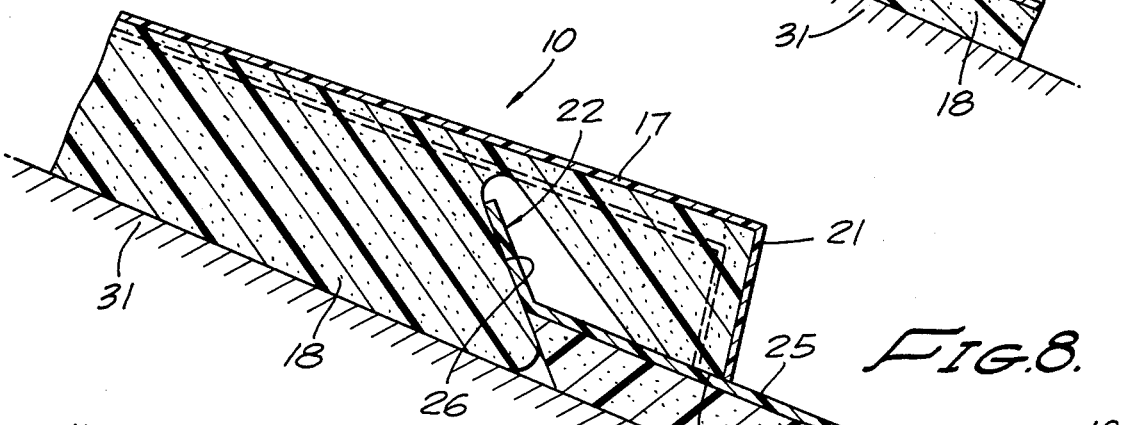
FIGS. 8 and 9 are sectional, elevational views taken along the lines 8—8 and 9—9, respectively, of FIG. 4.

Reference is now made simultaneously to FIGS. 2 and 3 where it is seen that that part of the shell 17 having the appearance of a plurality of shakes, has a cavity on the lower surface beginning at the nailing band 25 and having a step-like elevation with the thickest part being adjacent the lower edge 14. The foam 18 fills the interior of the shell 17 and includes a molded slot 26 extending angularly (i.e., 45 degrees) inwardly such as to enable receipt of a shell edge margin 22 of another panel therewithin. When so assembled with another panel, the headlap band 25 is in contact with faced-off area 27 of the foam body which is coextensive with the edges of the shell 17 while the shell edge margin 22 is in intimate, flush contact with one slot wall (FIG. 8). The remainder of the foam body extends slightly above the side edges of the shell as at 28 (FIG. 3).

With particular reference to FIG. 2, it is to be noted that an edge margin 29 of the foam body is faced off to be coextensive with the shell left side edge (i.e., side opposite the one with the ribs 15). This permits interlocking fitting with the ribs of an adjacently located panel as will be described.

Preliminary to applying panels 10 to a roof, a metal starter strip (not shown) is nailed to the roof and extends closely adjacent and parallel to the eave. The starter strip includes an upstanding metal flange which is received within the slot 26 of a first set of panels to be applied to the roof. Essentially, the starter strip forms a means for aligning the first panel and group of panels with respect to the eave or lower edge of the roof.

Figure 6:
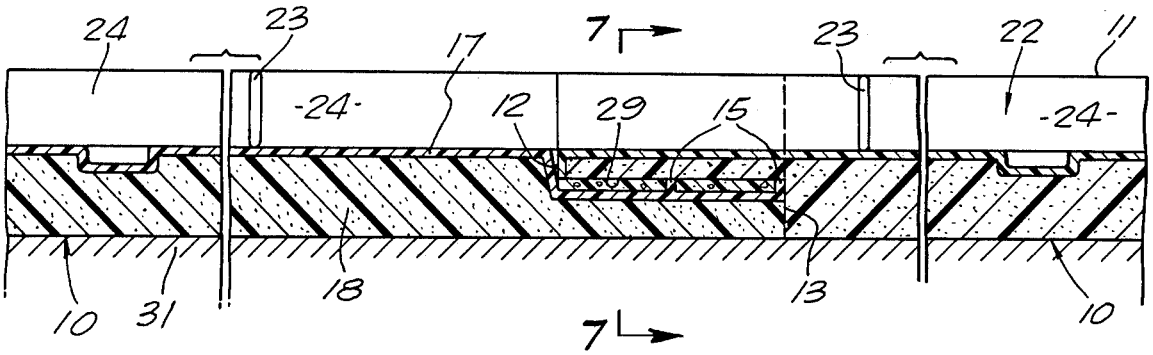
FIG. 6 is a sectional, elevational view taken along the line 6—6 of FIG. 4.
Figure 7:
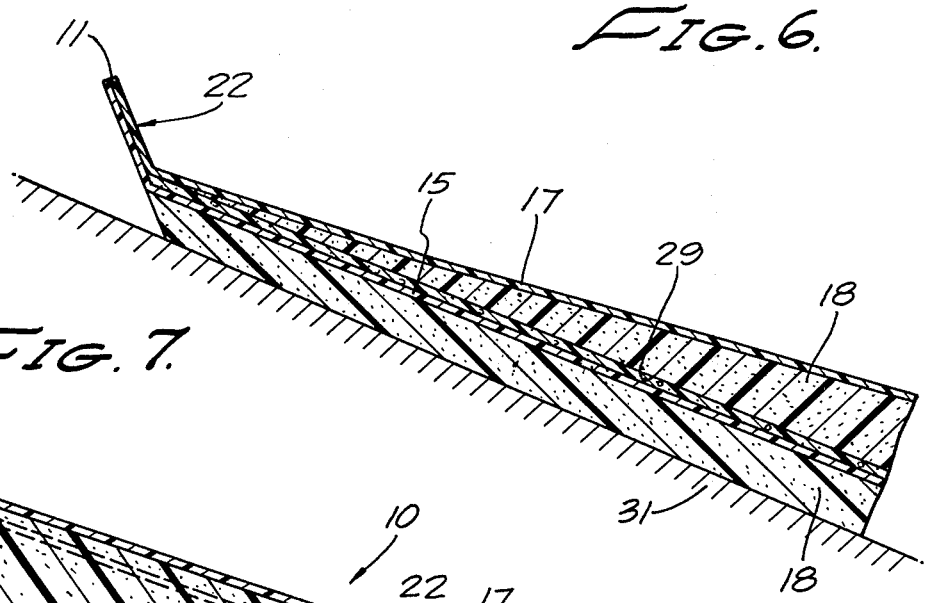
FIG. 7 is a sectional, elevational view taken along the line 7—7 of FIG. 6.
Figure 9:
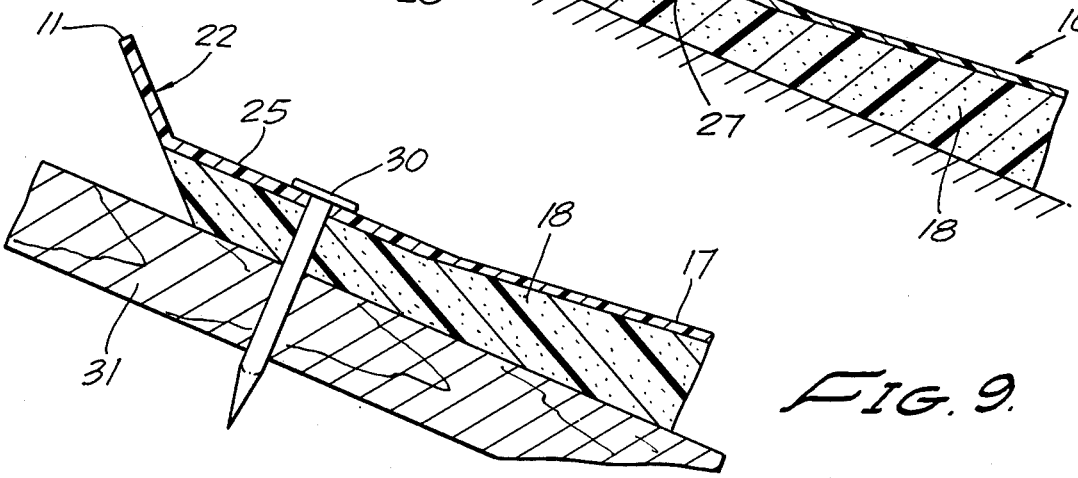

With the starter strip in place, a first panel 10 has its slot 26 received onto the starter strip flange and nails 30 are driven through the headlap band securing the panel to the roof 31 (FIG. 9). Next, a further panel may be added to the right of the first panel with the faced-off foam area 29 being pressed onto the ribs 15 of the first panel forming a watertight seal in that area (FIGS. 6 and 7). The adding of panels to the right may be continued across the roof, with the last panel so applied being cut to size by a saw, if need be.

The second row of panels is preferably started at the left, once again, with the rightmost tab 24 of the leftmost panel on the first panel row being removed so that there will be no obstruction from that source when the edge margin 22 is fitted into the accomodating slot 26. The panels may be applied as before until the second row of panels is laid down, the difference being the removal of a tab to accomodate the rib section of the next higher panel.

If it is desired, a row of panels may be started by using a half of a panel, for example, which will result in a staggered relation of the panels of that row with respect to an adjacent row. Such an arrangement will tend to make the appearance of the finished roof more random.

Although not shown, hip and ridge covering means are provided to protect exposed edges and for aesthetic purposes. Also, an elongated metal edging 32 may be clipped over the exposed edges of the panels extending along the roof edge to protect the foam from deteriorative ultraviolet rays of the sun as well as the lifting effect of wind and rain.

In addition, it has been found advisable to coat all surfaces of the cellular foam which are exposed to the rays of the sun. This is important since the foam is deteriorated by lengthy exposure to ultraviolet rays. An excellent material for this purpose, which is also fireproof, is a material sold under the trade style Gaco-Flex by Gaco Western of Seattle, Wash.

The invention claimed is:

1. A roofing panel for interfitting with other roofing panels to form a roofing surface, comprising:

a rigid molded shell having a decorative surface and an oppositely directed shallow cavity;

said shell having a top edge margined band extending across the full width of the shell and angularly directed upwardly and away from the decorative surface and a plurality of spaced thin-wall sections of the marginal band forming tabs of said band adapted to be selectively broken away and removed from the remainder of the band;

a side edge margin of the shell including continuous rib means facing in the same direction as the decorative surface; and a rigid foam body received in the molded shell cavity including a slot extending along and spaced from the shell lower edge adapted for receiving the top edge marginal of another roofing panel therein, and a faced-off outwardly directed surface adapted for receipt onto the rib means of another roofing panel.

2. A roofing panel as in claim 1, in which the shell is molded from a polyester plastic and has a wall thickness lying in the range of 0.030–0.060 inches.

3. A roofing panel as in claim 1, in which the foam body is constructed of a polyurethane foam having a density of about 2 pounds per cubic foot.

* * * * *